US011547900B2

(12) United States Patent
Oaks

(10) Patent No.: US 11,547,900 B2
(45) Date of Patent: Jan. 10, 2023

(54) EXERCISE WORKSTATION, COMPONENTS, AND METHODS

(71) Applicant: Brian Oaks, Highland, UT (US)

(72) Inventor: Brian Oaks, Highland, UT (US)

( * ) Notice: Subject to any disclaimer, the term of this patent is extended or adjusted under 35 U.S.C. 154(b) by 147 days.

(21) Appl. No.: 16/944,735

(22) Filed: Jul. 31, 2020

(65) Prior Publication Data

US 2021/0046354 A1 Feb. 18, 2021

Related U.S. Application Data

(60) Provisional application No. 62/897,194, filed on Sep. 6, 2019, provisional application No. 62/887,103, filed on Aug. 15, 2019.

(51) Int. Cl.
*A63B 22/06* (2006.01)
*A47B 83/00* (2006.01)
(Continued)

(52) U.S. Cl.
CPC ..... *A63B 22/0605* (2013.01); *A47B 83/001* (2013.01); *A63B 22/02* (2013.01);
(Continued)

(58) Field of Classification Search
CPC ..... A63B 22/0605; A63B 22/02; A63B 2022/0635; A63B 2208/0233; A63B 22/0235; A63B 22/0242; A63B 22/025; A63B 22/064; A63B 2022/0278; A63B 22/06; A63B 2022/0611–0658; A63B 2210/58; A63B 2208/0204; A63B 2210/50; A47B 83/001; A47B 2220/06;
(Continued)

(56) References Cited

U.S. PATENT DOCUMENTS 3,870,297 A 3/1975 Elder
5,226,866 A * 7/1993 Engel ..... A63B 22/02 482/52
(Continued)

FOREIGN PATENT DOCUMENTS

CN 1206008 C 6/2005
CN 201239468 Y * 5/2009
(Continued)

OTHER PUBLICATIONS

Amazon.com "K-TOR Emergency Disaster Kit: 20 watt Pedal Generator Bundled with 1 amp USB Hand Crank Generator and Cree USB Flashlight with USB Connector" (Year: 2017).*
(Continued)

*Primary Examiner* — Megan Anderson
(74) *Attorney, Agent, or Firm* — Workman Nydegger

(57) ABSTRACT

An exercise workstation includes a treadmill, a pedal exercise device disposed on or next to the treadmill, and a chair pivotally secured to the exercise workstation. The chair can be repositioned relative to the treadmill, such as above or to the side of the treadmill. A pivot arm is pivotally connected to a pivot joint to permit multiple positional adjustments of the chair. The pivot joint may be connected to the treadmill in fixed or movable position. The exercise workstation may include or be positioned adjacent to one or more work surfaces, such as a height adjustable desk or table.

15 Claims, 17 Drawing Sheets

(51) Int. Cl.
*A63B 22/02* (2006.01)
*A47B 83/02* (2006.01)

(52) U.S. Cl.
CPC ..... *A47B 2083/025* (2013.01); *A47B 2220/06* (2013.01); *A63B 2022/0635* (2013.01); *A63B 2208/0204* (2013.01); *A63B 2208/0233* (2013.01); *A63B 2210/50* (2013.01)

(58) Field of Classification Search
CPC ..... A47B 9/00; A47B 17/02; A47B 21/02; A47B 2083/025; A47C 9/002; A47C 15/004
See application file for complete search history.

(56) References Cited

U.S. PATENT DOCUMENTS

| | | | | |
|---|---|---|---|---|
| 7,892,150 | B1 | 2/2011 | Colley | |
| 8,801,581 | B2 * | 8/2014 | Lai | A63B 22/02 482/142 |
| 9,084,911 | B2 * | 7/2015 | Hsu | A63B 69/0064 |
| 9,498,696 | B1 * | 11/2016 | Razon | A63B 22/0046 |
| 9,955,789 | B2 * | 5/2018 | Herring | A47C 7/006 |
| 2005/0054492 | A1 | 3/2005 | Neff | |
| 2006/0247109 | A1 * | 11/2006 | Powell | A63B 22/02 482/904 |
| 2008/0096745 | A1 | 4/2008 | Perry | |
| 2013/0116092 | A1 * | 5/2013 | Martinez | A63B 24/0062 482/9 |
| 2014/0360413 | A1 | 12/2014 | Schenk et al. | |
| 2015/0251047 | A1 | 9/2015 | Maanitty et al. | |
| 2015/0351553 | A1 * | 12/2015 | Herring | A47B 97/00 108/50.11 |

FOREIGN PATENT DOCUMENTS

| | | | |
|---|---|---|---|
| CN | 202715179 | U | 2/2013 |
| CN | 107866033 | A | 4/2018 |
| CN | 107913492 | A | 4/2018 |
| WO | 88/00850 | A1 | 2/1988 |
| WO | 2016/191853 | A1 | 12/2016 |

OTHER PUBLICATIONS

Amazon.com "Drive Medical 13085LN Left Side Seat Lift Chair Overbed Table, Walnut" (Year: 2004).*
International Preliminary Report on Patentability received for PCT Patent Application No. PCT/US20/45786, dated Feb. 24, 2022, 8 pages.
International Search Report and Written Opinion received for PCT Patent Application No. PCT/US20/45786 dated Dec. 15, 2020, 11 pages.
Invitation to Pay Additional Fees received for PCT Patent Application No. PCT/US20/45786, mailed on Sep. 30, 2020, 2 pages.

* cited by examiner

EXERCISE WORKSTATION, COMPONENTS, AND METHODS

CROSS REFERENCE TO RELATED APPLICATIONS

This application claims the benefit of U.S. Prov App No. 62/887,103, filed Aug. 15, 2019, and U.S. Prov App No. 62/897,194, filed Sep. 6, 2019, which are incorporated by reference in their entirety.

BACKGROUND OF THE INVENTION

1. The Field of the Invention

The present disclosure relates generally to workstations, exercise apparatus, systems and methods. More specifically, the present disclosure relates to apparatus, systems and methods for reconfigurable exercise workstations.

2. Background and Relevant Art

To avoid health problems associated with excessive sedentariness, many people walk, stand, or otherwise reposition themselves when working at a desk. While standing has been shown to be healthier than sitting for long periods of time, it has also been shown that movement is even more important to avoid health problems associated with excessive sitting. Many standing desk configurations and exercise workstations have been developed to accommodate those who want to stand or walk during work.

However, current exercise workstations lack reconfigurability such that changing positions during work throughout the day is burdensome. For example, a person may not want to stand or walk all day during work, but may wish to alternate between standing, sitting, and walking. Exercise workstations are typically bulky and heavy so that rearranging the orientation and configuration of such equipment is difficult. Also, many of the current systems are configured to only work with a limited set of desks and relative positions thereof.

In addition, many of the exercise workstations of the prior art present safety hazards to those who want to move at a stationary desk during work. For example, when treadmills are used for walking at a desk, there are often obstacles present behind the person or elsewhere that can cause injury in the case of tripping or falling on the treadmill, or simply because of inattentiveness. Also, current exercise workstations lack sufficient user interfaces to enable fitness tracking and reporting.

Accordingly, there are a number of problems with exercise workstations in the prior art that need to be addressed.

SUMMARY

Embodiments described herein solve one or more problems in the art with workstation apparatus, systems and methods. More specifically, the present disclosure relates to apparatus, systems and methods for reconfigurable exercise workstations.

In some embodiments, an exercise workstation can include a treadmill, exercise pedals, and a chair. The pedals can be disposed on or next to the treadmill, and the chair can be pivotally secured to the exercise workstation such that the chair can be repositioned relative to the treadmill. The chair and pedals can be selectively locked at a fixed distance when used together to prevent inadvertent separation of the person and pedals.

In some embodiments, an exercise workstation can include a treadmill and a chair that can be selectively positioned relative to the treadmill by a pivot joint and a pivot arm. The pivot joint is connected to the exercise workstation, and the pivot arm is pivotally connected to the pivot joint. The chair is connected to the pivot arm such that the chair can be pivotally repositioned either over the tread mill or to a side of the treadmill by pivoting the pivot arm relative to the pivot joint during use.

In some embodiments, an existing treadmill can be modified to incorporate a chair, pivot arm, and pivot joint to function with a workstation. The treadmill can be modified to incorporate exercise pedals to provide additional exercise functionality.

In some embodiments, the chair that is or can be attached to the treadmill can be configured to be selectively collapsible and expandable when alternating between storage and use. For example, the chair can be configured with a folding seat back that can move between an essentially vertical position when functioning as a seat back during use and an essentially horizontal position to facilitate storage, such as beneath a desk.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and should not therefore be considered to be limiting of its scope, the invention will be described and explained with additional specificity and detail through the use of the accompanying drawings in which.

DETAILED DESCRIPTION

Embodiments described in the present disclosure solve one or more problems in the art with workstation systems and apparatus. More specifically, the present disclosure relates to apparatus, systems, and methods for reconfigurable exercise workstations that provide easy-to-reconfigure setups that permit a person to efficiently switch from walking, to standing, or to sitting while working at a desk, table, or other work surface. In addition, the reconfigurable exercise workstations of the present disclosure minimize physical hazards to ensure a safe transition between the various configurations to prevent or minimize accidental slipping or falling during use.

Reference is now made to the drawings. Although the various embodiments and views may be characterized as separate embodiments, a person skilled in the art will readily appreciate that any feature(s) depicted in one or more drawings and/or described with respect to one or more embodiments, can be incorporated, added, or otherwise included in any other embodiment. Thus, any feature depicted and/or described with respect to any figure can be incorporated into any other figure without detracting from the invention.

Figure 1:
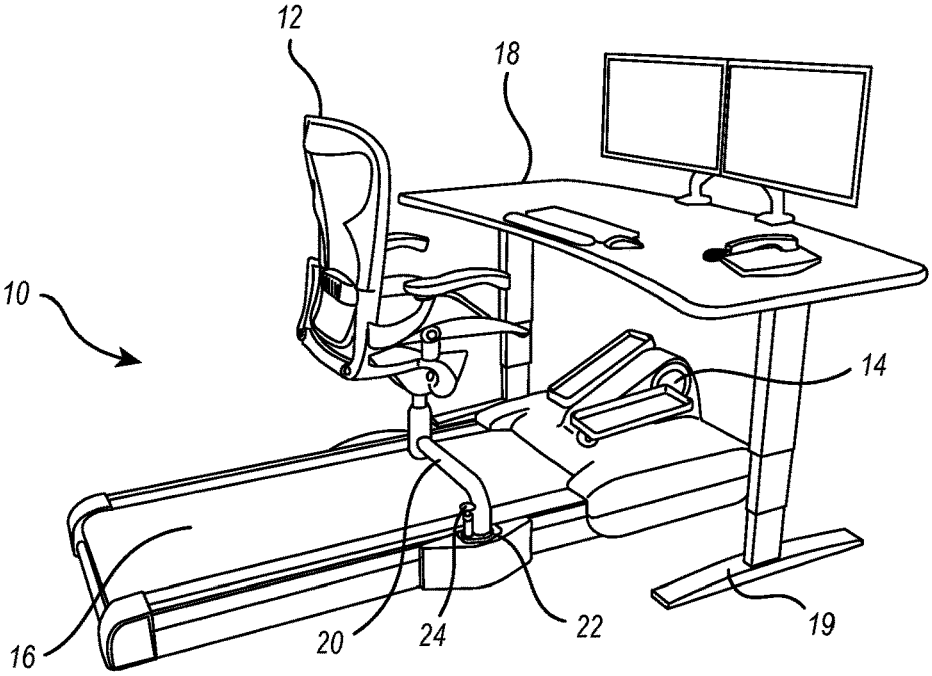
FIG. 1 is a side perspective view illustrating an embodiment of an exercise workstation, including a chair and pedals situated relative to a treadmill next to a work surface.

FIG. 1 illustrates an embodiment of an exercise workstation 10, including a chair 12 and a pedal exercise device 14 situated relative to a treadmill 16 positioned near a work surface 18. In the illustrated embodiment, chair 12 is situated above treadmill 16 via pivot arm 20. Pivot arm 20 extends from pivot joint 22 to chair 12. As shown, in at least one embodiment, pivot joint 22 extends from a side of treadmill 16.

In some embodiments, pivot arm 20 and pivot joint 22 can be locked or unlocked as desired by manipulating a pivot lock 24. This permits selective unlocking, moving, and locking of pivot arm 20 in one of several positions relative to treadmill 16. The pivot arm 22 and pivot lock 24 can interact with each other and/or adjacent features (e.g., through one or more of a pin and hole arrangement, clamps, and/or intermeshing teeth).

In one or more other embodiments, pivot joint 22 may be disposed at locations other than at a side of treadmill 16. For example, in at least one embodiment, pivot joint 22 may be disposed on a lower surface of work surface 18 or a stand 19 supporting work surface 18, such that chair 12 is connected to work surface 18 or stand 19 via a pivot arm 20 (not shown). Also, for example, pivot joint 22 may be disposed to one side of treadmill 16 but not formed integrally with treadmill 16. Also, in at least one embodiment, workstation 10 may include more than one pivot joint 22, including an opposing pivot joint (not shown) disposed on an opposing side of treadmill 16. In such embodiment, a user has the option to reconfigure pivot arm 20 to extend from any number of pivot joints 22, whether disposed on or around treadmill 16 or on work surface 18 or stand, as discussed above.

In addition, in at least one embodiment, pivot joint 22, or multiple pivot joints as noted above, can be connected, either permanently or removably, to treadmill 16 via a track (not shown). In such an embodiment, the position of pivot joint 22, and thus chair 12, along the edge of treadmill 16 can be adjusted to adjust the position of chair 12 either above or to the side of treadmill 16 at various longitudinal positions. For example, the track may allow repositioning of chair 12 and pivot joint 22 at intervals and/or anywhere in between the front and back end of treadmill 16.

Pivot arm 20 extends from pivot joint 22 and can rotate about pivot joint 22 to reposition chair 12. For example, in at least one embodiment, a user can rotate pivot arm 20 to reposition chair 12 to the side of treadmill 16, or above treadmill 16 but closer or further away from work surface 18. In addition, in at least one embodiment, pivot arm 20 is rotationally connected to chair 12 such that chair 12 can rotate about pivot arm 20 to point in different directions. Chair 12 is illustrated as a typical office chair; however, one or more other embodiments may include other sitting devices in addition to or in place of chair 12, including, but not limited to, stools, cushions, exercise balls, and the like. Exercise workstation 10 also includes pedal exercise device 14, which may be utilized by a user when sitting in chair 12 (e.g., above treadmill 16).

In addition, in at least one embodiment, work surface 18 is capable of moving up and down depending on the needs of the user. During use, and as configured in FIG. 1, a user can sit in chair 12 and utilize work surface 18 while engaging pedal exercise device 14. In at least one embodiment, pivot arm 20 can be locked in place once the user has positioned chair 12 as desired so that a stationary force transferred from the treadmill to chair 12 maintain the chair in a fixed position (or permit minimal movement) to facilitate user engagement of pedal exercise device 14 with the user's feet without moving chair 12 out of a desired position. Pedal exercise device 14 can also be permanently or temporarily secured to treadmill 16 to prevent unwanted movement away from chair 12 during use.

Figure 2:
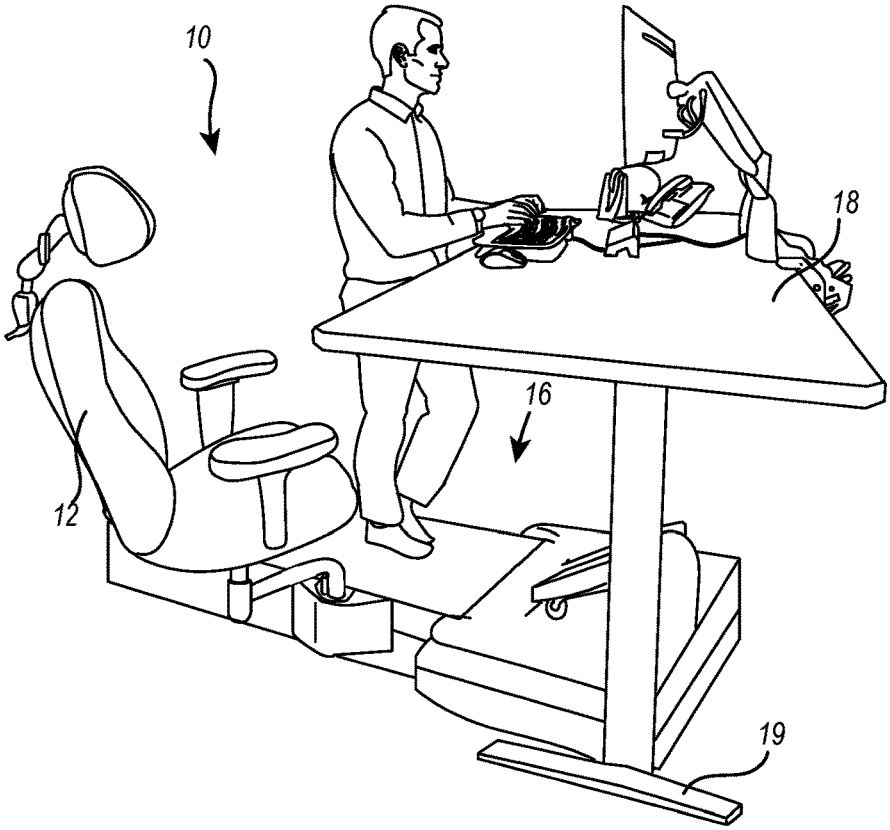
FIG. 2 is a side perspective view illustrating an embodiment of an exercise workstation with a chair situated at a side of a treadmill and a person walking on the treadmill while positioned next to a work surface.

FIG. 2 illustrates an embodiment of an exercise workstation 10 with chair 12 moved to the side of the treadmill 16 to permit a user to walk or stand on treadmill 16 (depending on whether the treadmill belt is moving or stationary). As shown, chair 12 can be advantageously moved away from above treadmill 16 when the user desires to walk or stand on treadmill 16. Pivoting chair 12 to one side of treadmill 16 provides room for the user to utilize treadmill 16 and reduces the risk of injury from slipping or tripping and being drawn backward into chair 12, which can cause the user to fall and/or sustain injury. Rather, chair 12 can be safely pivoted to the side of treadmill 16 as illustrate in FIG. 2 so that chair 12 does not pose an injury risk to the user.

In addition, as noted above, work surface 18 can be designed to be selectively moveable up or down to accommodate the user's standing height when the user stands and/or walks on treadmill 16 during use. In at least one embodiment, work surface 18 includes a number of control buttons or other control interfaces (not shown) for controlling the height of work surface 18 and/or the activation of treadmill 16 and pedal exercise device 14. Additionally, or alternatively, control interfaces can be located on chair 12, pedal exercise device 14, and/or treadmill 16. The exercise workstation 10 can also include a wire and an outlet that can provide electrical power to the exercise workstation 10, allowing a user to plug in electronic devices, such as, for example, a computer.

Figure 3:
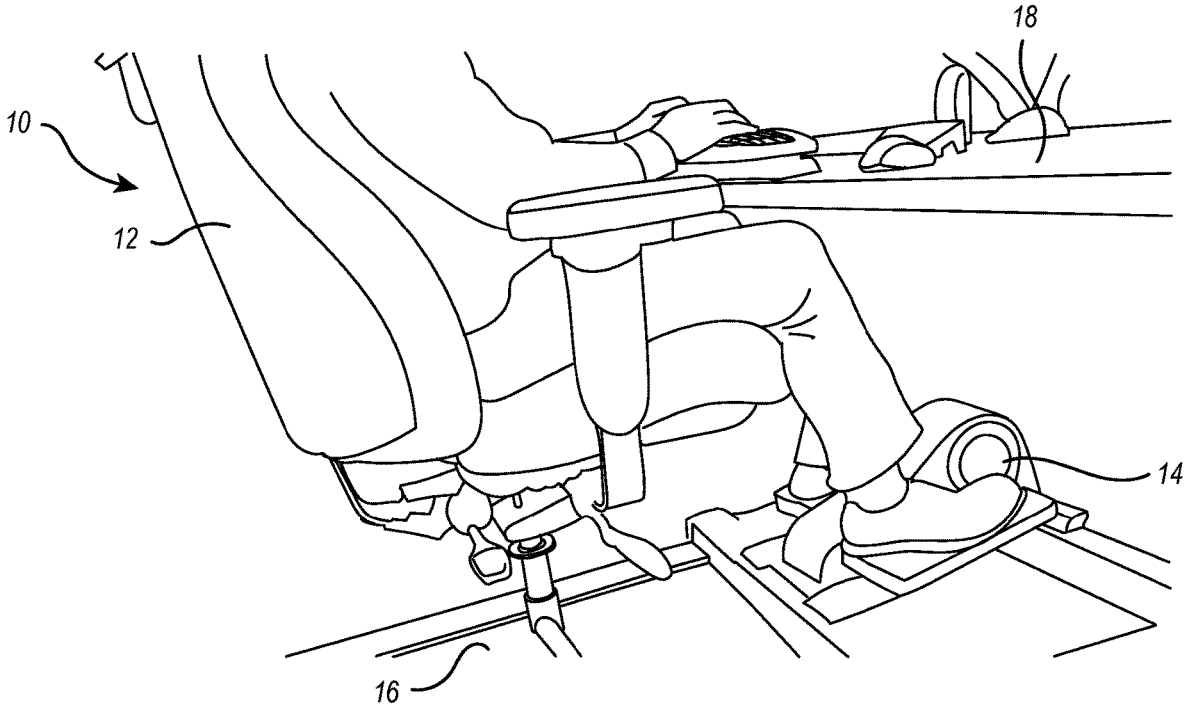
FIG. 3 is a side perspective view illustrating an embodiment of an exercise workstation with a chair disposed over a treadmill and a person sitting on the chair and engaging pedals while positioned next to a work surface.

FIG. 3 illustrates an embodiment of an exercise workstation 10 with chair 12 disposed over a treadmill 16 and a user sitting on chair 12 and engaging pedal exercise device 14 if desired. When the user wants to sit down, after or prior to standing and/or walking on treadmill 16, as shown in FIG. 2, the user can pivot chair 12 over treadmill 16 to be situated in front of work surface 18. Also, the user may choose to sit in chair 12 regardless of the position of chair 12 relative to treadmill 16. For example, the user can sit in chair 12 when chair 12 is pivoted to one side of treadmill 16, as shown in FIG. 2, to engage with another work surface to the side of treadmill 16. More details regarding the variety of positions available based on the repositioning of chair 12 via pivot arm 20 will be described in reference to subsequent figures.

Figure 4:
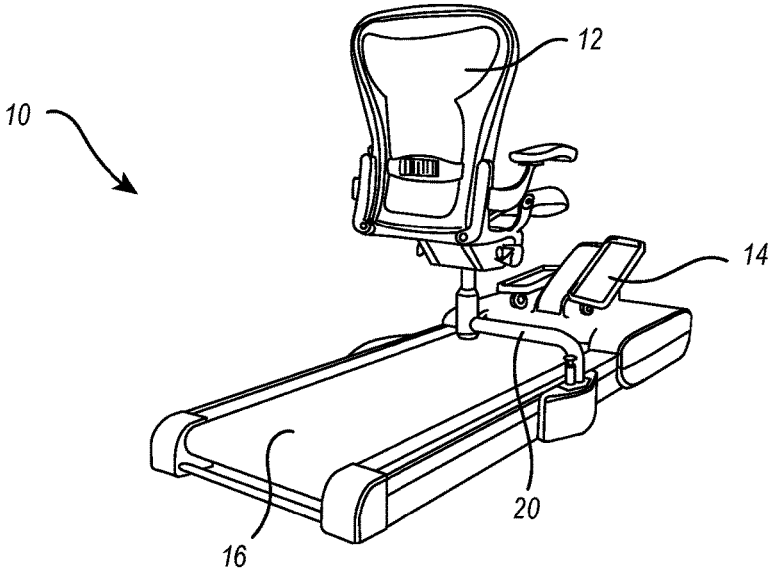
FIG. 4 is a rear side perspective view illustrating an embodiment of an exercise device for incorporation into a workstation, including a chair and pedals situated relative to a treadmill, which can be positioned next to a work surface.

FIG. 4 illustrates an embodiment of an exercise workstation 10, including chair 12 and pedal exercise device 14 situated relative to (e.g. at the front end of) treadmill 16. Chair 12 may include features of office chairs or other chairs known in the art, such as backrest and armrest adjustability, and so forth. In addition, in at least one embodiment, chair 12 is height adjustable relative to pivot arm 20 such that chair 12 can be selectively raised or lowered to accommodate various heights of different persons and/or work surfaces. Armrests of chair 12 can also be adjustable to accommodate various persons and/or work surfaces such that armrests of chair 12 do not contact work surfaces when chair 12 pivots about pivot arm 20.

In the illustrated embodiment of FIG. 4, pedal exercise device 14 is disposed at a front end of treadmill 16. However, in at least one embodiment, pedal exercise device 14 can be disposed at the back end of treadmill 16. In at least one embodiment, two pedal exercise devices 14 may be disposed on treadmill 16, with one device at each end, such that a user can pivot chair 12 to face either direction and be able to engage a pedal exercise device 14. In addition, in at least one embodiment, treadmill 16 may include a track for walking that can operate in both directions, thus enabling a user to walk on treadmill 16 while working on a work surface disposed at either end of treadmill 16.

Figure 5:
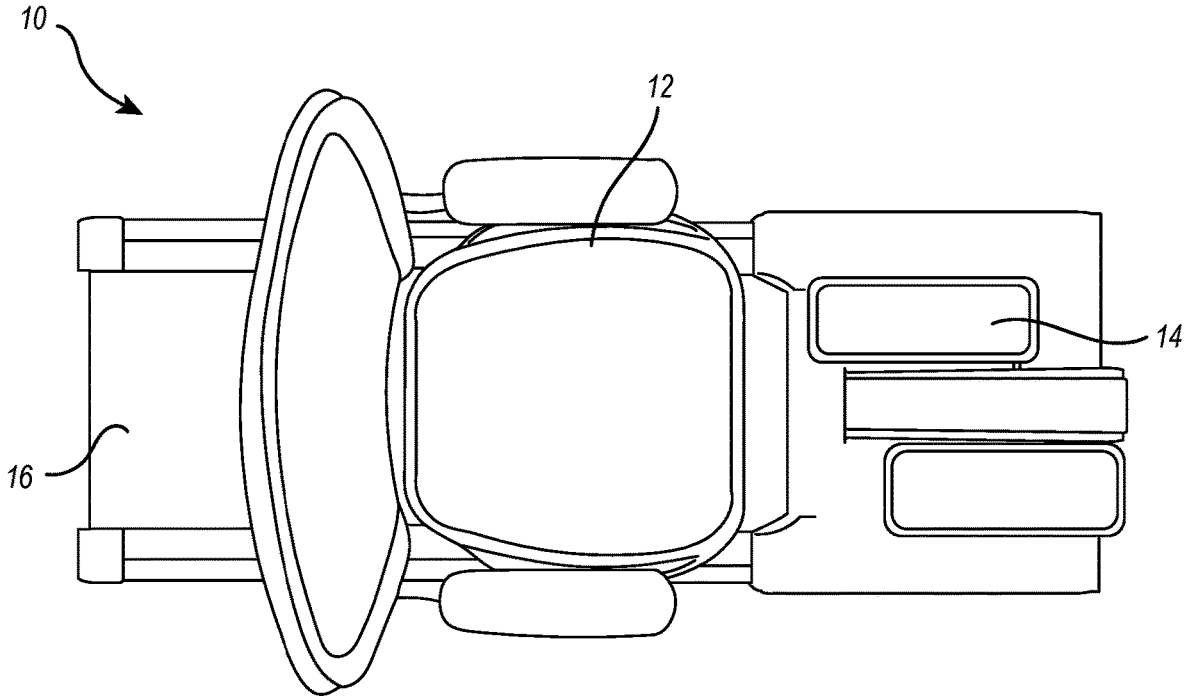
FIG. 5 is a top view illustrating an embodiment of an exercise device for incorporation into a workstation, including a chair and pedals situated relative to a treadmill, which can be positioned next to a work surface.

FIG. 5 illustrates an embodiment of an exercise workstation 10, including a chair 12 and pedal exercise device 14 situated relative to a treadmill 16. The top view presented in FIG. 5 illustrates the relative position of chair 12 and pedal exercise device 14 when chair 12 is disposed above treadmill 16. In at least one embodiment, pedals of a pedal exercise device 14 are reachable by the feet of a user while sitting in chair 12. In at least one embodiment, chair 12 can be adjusted forward, backward, left, or right relative to pivot arm 20 such that the distance and relative position of chair 12 and pedal exercise device 14 can be optimized for different users of different sizes and heights.

Figure 6:
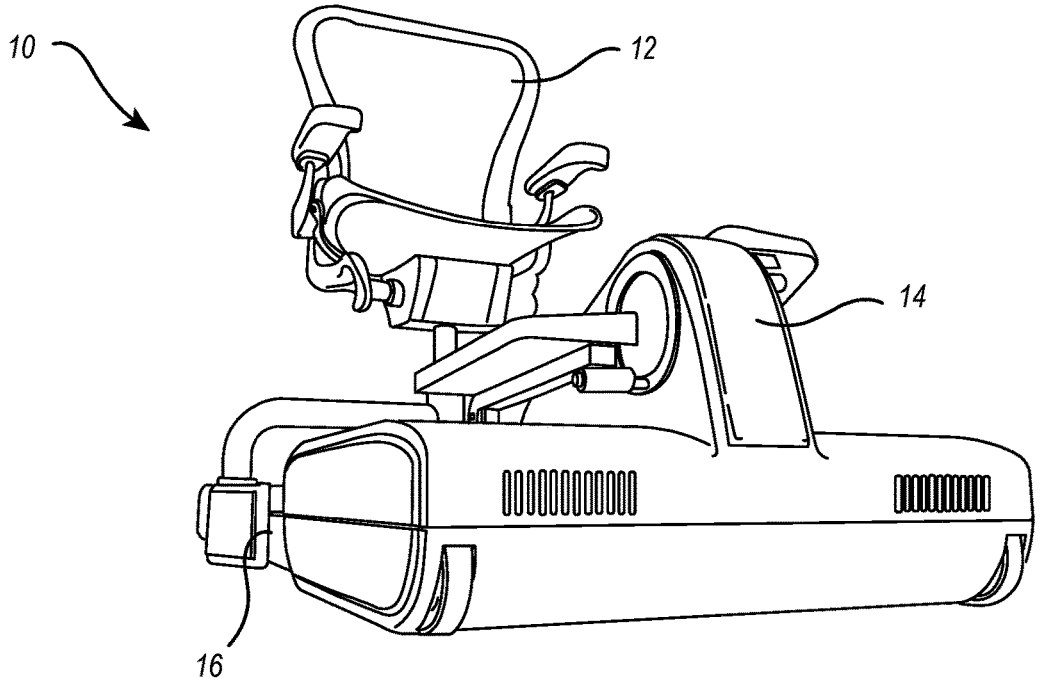
FIG. 6 is a front perspective view illustrating an embodiment of an exercise device for incorporation into a workstation, including a chair and pedals situated relative to a treadmill, which can be positioned next to a work surface.

FIG. 6 illustrates an embodiment of an exercise workstation 10, including a chair 12 and pedal exercise device 14 situated relative to treadmill 16. The view in FIG. 6 highlights pedal exercise device 14, which is disposed at one end of treadmill 16. In at least one embodiment, pedal exercise device 14 is integrally formed with treadmill 16 such that it cannot easily be removed therefrom. For example, the housing surrounding components of pedal exercise device 14 may be the same housing that surrounds treadmill 16. Alternatively, or additionally, pedal exercise device 14 may be separate from treadmill 16 such that one or more pedal exercise devices 14 can be arranged on either end of treadmill 16 or to the sides of treadmill 16 for use in a variety of chair positions and configurations.

In at least one embodiment, pedal exercise device 14 includes an electric generator (internal or not shown) that produces electric power when a user moves the pedals pedal exercise device 14. In such an embodiment, exercise workstation 10 conserves energy by operating, at least in part, off of power generated by the electric generator. Alternatively, or additionally, computers or other devices used by user on work surface 18 or elsewhere can also be powered, at least in part, by electrical power generated by the electric generator associated with pedal exercise device 14.

Power generated by the pedal exercise device 14 may be stored in a battery (not shown). The battery may be incorporated into the electrical system of the pedal exercise device 14 or integrated into another element of workstation 10. In some embodiments, the battery may be an external battery which can be selectively removed from the workstation 10. A removable battery may be advantageous to allow the user to easily replace the battery. This may allow a user to charge multiple batteries, thereby providing the user with charged batteries which can be added to the workstation 10 to provide power at times when the user does not want to pedal to generate power.

Figure 7:
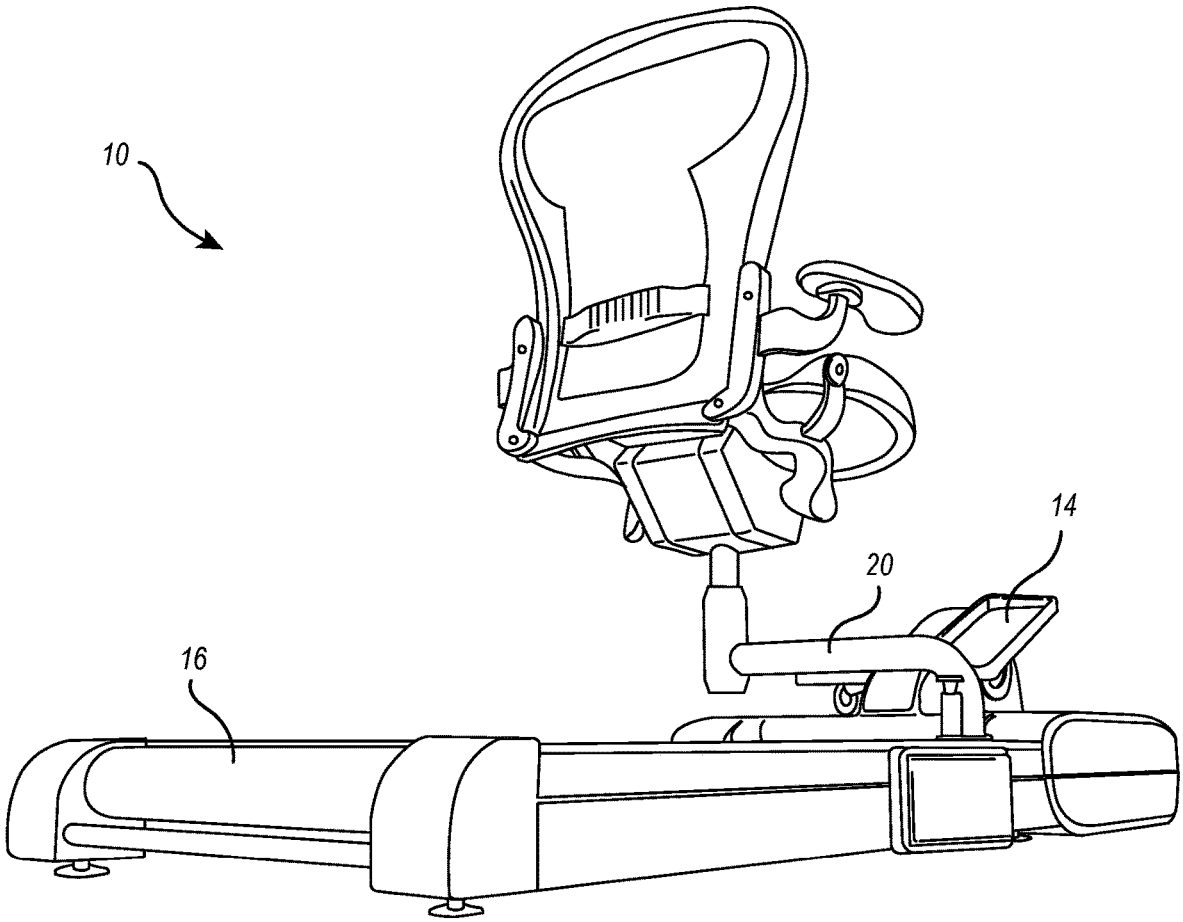
FIG. 7 is a rear perspective view illustrating an embodiment of an exercise device for incorporation into a workstation, including a chair and pedals situated relative to a treadmill, which can be positioned next to a work surface.

FIG. 7 illustrates an embodiment of an exercise workstation 10, including a chair 12 and pedal exercise device 14 situated relative to a treadmill 16, with chair 12 disposed above treadmill 16. This illustrated view highlights the vertical positions of chair 12 and pivot arm 20 relative to treadmill 16. In at least one embodiment, chair 12 hovers above treadmill 16 via pivot arm 20 such that a gap is formed between pivot arm 20 and treadmill 16 (e.g., so that pivot arm 20 and chair 12 do not interfere with proper operation of treadmill 16). In one or more other embodiments, the gap between treadmill 16 and pivot arm 20, and thus the vertical distance of chair 12 relative to treadmill 16, may vary. In any case, pivot arm 20 and chair 12 do not contact the top surface of treadmill 16, either when chair 12 is disposed above treadmill 16 or is pivoted in a different position.

Figure 8:
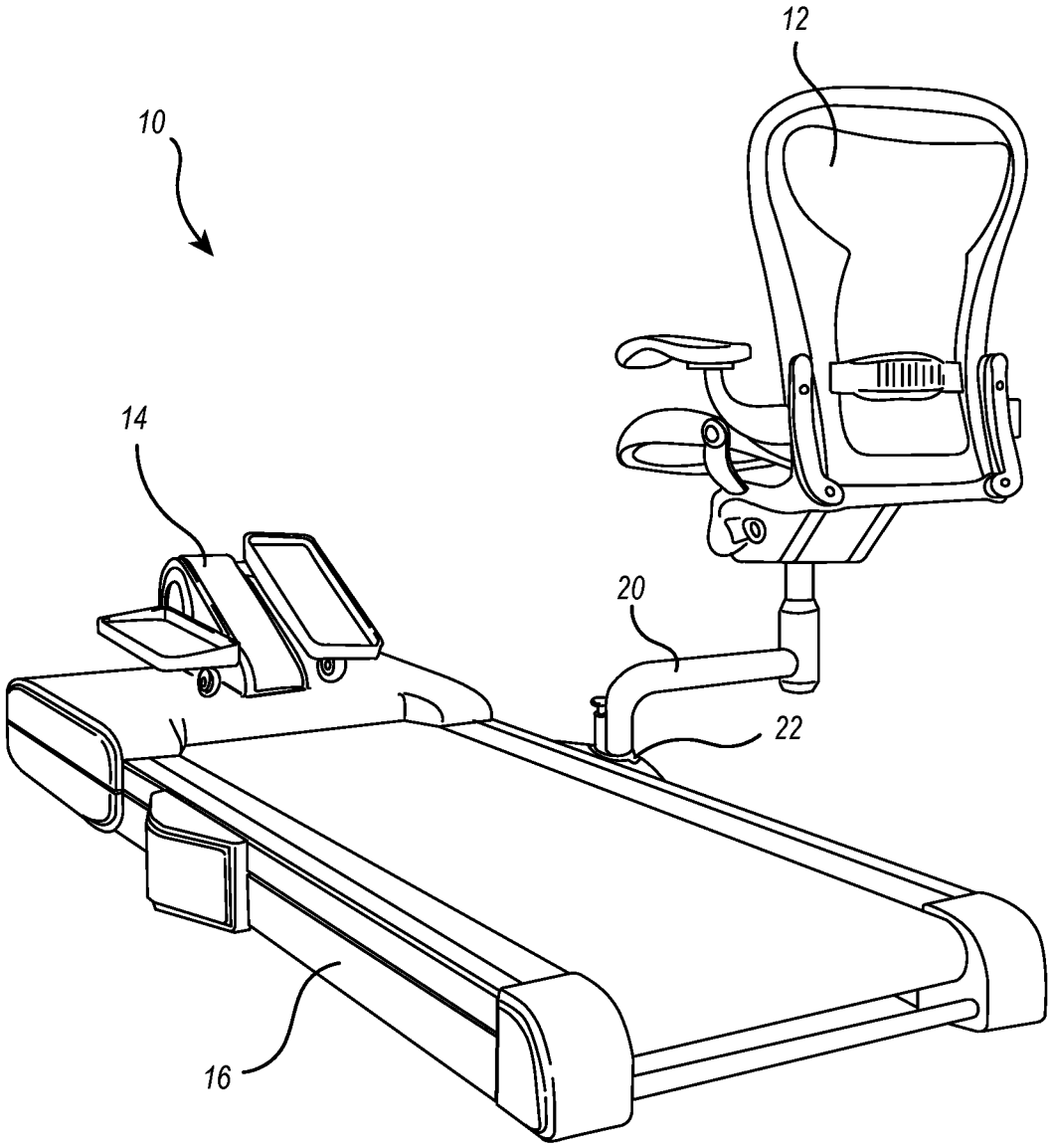
FIG. 8 is a rear side perspective view illustrating an embodiment of an exercise device for incorporation into a workstation, including a chair and pedals situated relative to a treadmill, with the chair selectively situated to a side of the treadmill.

FIG. 8 illustrates an embodiment of an exercise workstation 10, including a chair 12 and pedal exercise device 14 situated relative to a treadmill 16, with chair 12 selectively positioned to one side of treadmill 16. Again, as noted above, chair 12 can be locked in position after being rotated to the side of treadmill 16 via pivot arm 20 rotating around pivot joint 22. Alternatively, the user can leave pivot arm 20 unlocked such that chair 12 can be freely moved back and forth around pivot joint 22 to various positions. Chair 12 can be moved out of the way to allow the user to walk on treadmill 16 or remain seated in chair 12 in any position. The reconfigurability of chair 12 allows a user to utilize chair 12 in a variety of positions relative to treadmill 16 and therefore work at a work surface disposed at a number of different positions relative to treadmill 16.

Figure 9:
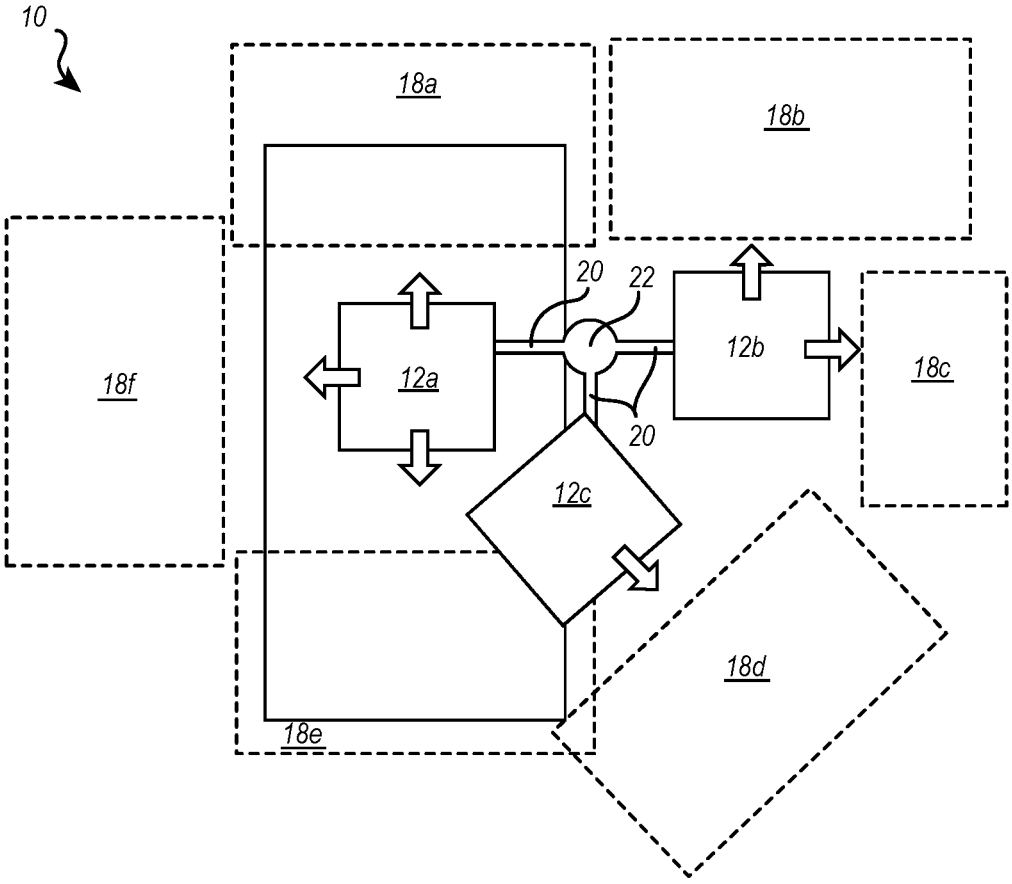
FIG. 9 is a top schematic view illustrating an embodiment of an exercise workstation, including a variety of work surfaces situated relative to a treadmill and a variety of chair positions relative to the treadmill.

To further illustrate the ergonomic adaptability and reconfigurability of exercise workstation 10, FIG. 9 is a schematic view that illustrates an embodiment of an exercise workstation 10, including a variety of work surfaces 18*a*-18*f* situated relative to treadmill 16 and a variety of non-limiting chair positions 12*a*-*c* relative to treadmill 16. As shown, chair 12 can be positioned in a variety of positions via pivot arm 20 and pivot joint 22. In the illustrated schematic of FIG. 9, chair 12 is shown in 3 distinct positions 12*a*, 12*b*, and 12*c*. In addition to the overall position of chair 12, chair 12 may swivel about pivot arm 20 to point in a variety of directions at each position 12*a*, 12*b*, and 12*c*. Some examples of swivel positions of chair 12 at each chair position 12*a*, 12*b*, and 12*c* are indicated by arrows. It will be readily appreciated that chair 12 can be moved into other positions and/or directed not specifically shown in FIG. 9.

The various chair positions 12*a*, 12*b*, and 12*c* illustrated in FIG. 9 allow a user to work at any of a number of positions corresponding to the positions of work surfaces 18*a*-18*f*. The position of each work surface 18*a*-18*f*, indicated in dotted lines, may correspond to a position of a desk, table, or other work surface. In at least one embodiment, a user can arrange two or more work surfaces 18 relative to treadmill 16 to enjoy multiple different work surface orientations. In such embodiments, the user can rotate chair 12 relative to pivot arm 20 and/or rotate chair 12 around pivot joint 22, to alternate between one work surface 18*a*-18*f* to another as needed or desired.

The positions of chair 12, treadmill 16, and work surfaces 18*a*-18*f* schematically illustrated in FIG. 9 are exemplary only and are not meant to exclude other positions not shown. One will appreciate that pivot joint 22 and pivot arm 20 enable chair 12 to be positioned in any position around pivot joint 22, rather than just the distinct position shown in FIG. 9. In addition, chair 12 may be rotated relative to pivot arm 20 in any direction rather than just the directions indicated by the arrows in FIG. 9. Thus, based on the rotation of pivot arm 20 around pivot joint 22 and rotation of chair 12 relative to pivot arm 20, the user can selectively position and reposition chair 12 relative to work surfaces 18 positioned anywhere around treadmill 16.

Figure 10:
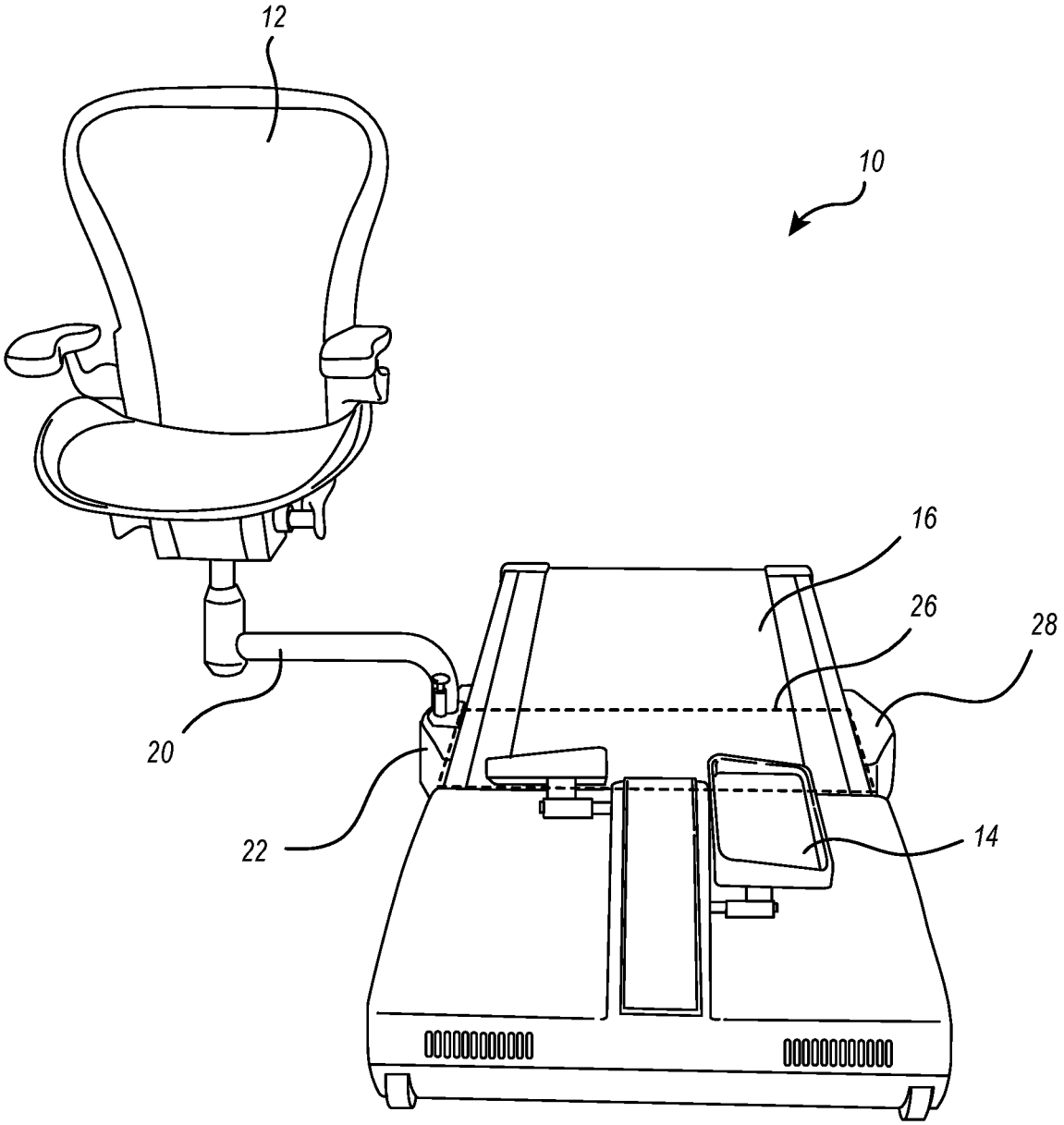
FIG. 10 is a front perspective view illustrating an embodiment of an exercise device for incorporation into a workstation, with a chair situated to a side of a treadmill and a support plate disposed underneath the treadmill.

FIG. 10 illustrates an embodiment of an exercise workstation 10 with chair 12 situated to one side of a treadmill 16. In at least one embodiment, pivot joint 22 is connected to a plate 26 positioned beneath treadmill 16. In at least one embodiment, the opposing side of plate 26 is connected to a vertical support 28, which is disposed on the opposite side of treadmill 16 relative to pivot joint 22 in order stabilize the weight imbalance and offset tipping forces applied by a person sitting in chair 12. In at least one embodiment, as discussed above, where exercise workstation 10 includes two or more pivot joints 22, at least one pivot joint can be disposed on vertical support 28.

In at least one embodiment, plate 26 extends underneath treadmill 16 and is connected to pivot arm 20 via pivot joint 22. In this way, when chair 12 is pivoted to the side of treadmill 16, plate 26 and vertical support 28 prevent exercise workstation 10 from tipping over. By connecting chair 12 to the other side of treadmill 16, plate 26 and vertical support 28 attach to treadmill 16 so that the center of gravity is further away from the center of chair 12. Thus, when the user sits in chair 12 to one side of treadmill 16, the weight of treadmill 16 counteracts the weight of the user and chair 12. Plate 26 and/or vertical support may provide sufficient weight to at least partially offset the weight of a user sitting in chair 12. Additional stabilizing weights (not shown) can be attached to plate 26 and/or vertical support 28 as needed depending on the weight of the user and/or treadmill.

Plate 26 is indicated in dotted lines to illustrate that in at least one embodiment, plate 26 is disposed beneath treadmill 16. Plate 26 may be comprised of any material durable and strong enough to provide the counterbalance functions described above. In addition, the size and shape of plate 26 may vary in one or more other embodiments without diminishing the function thereof. In addition to or alternatively to plate 26 shown in FIG. 10, at least one embodiment of an exercise workstation 10 includes a support 28 secured to and extending away from treadmill 16.

Figure 11:
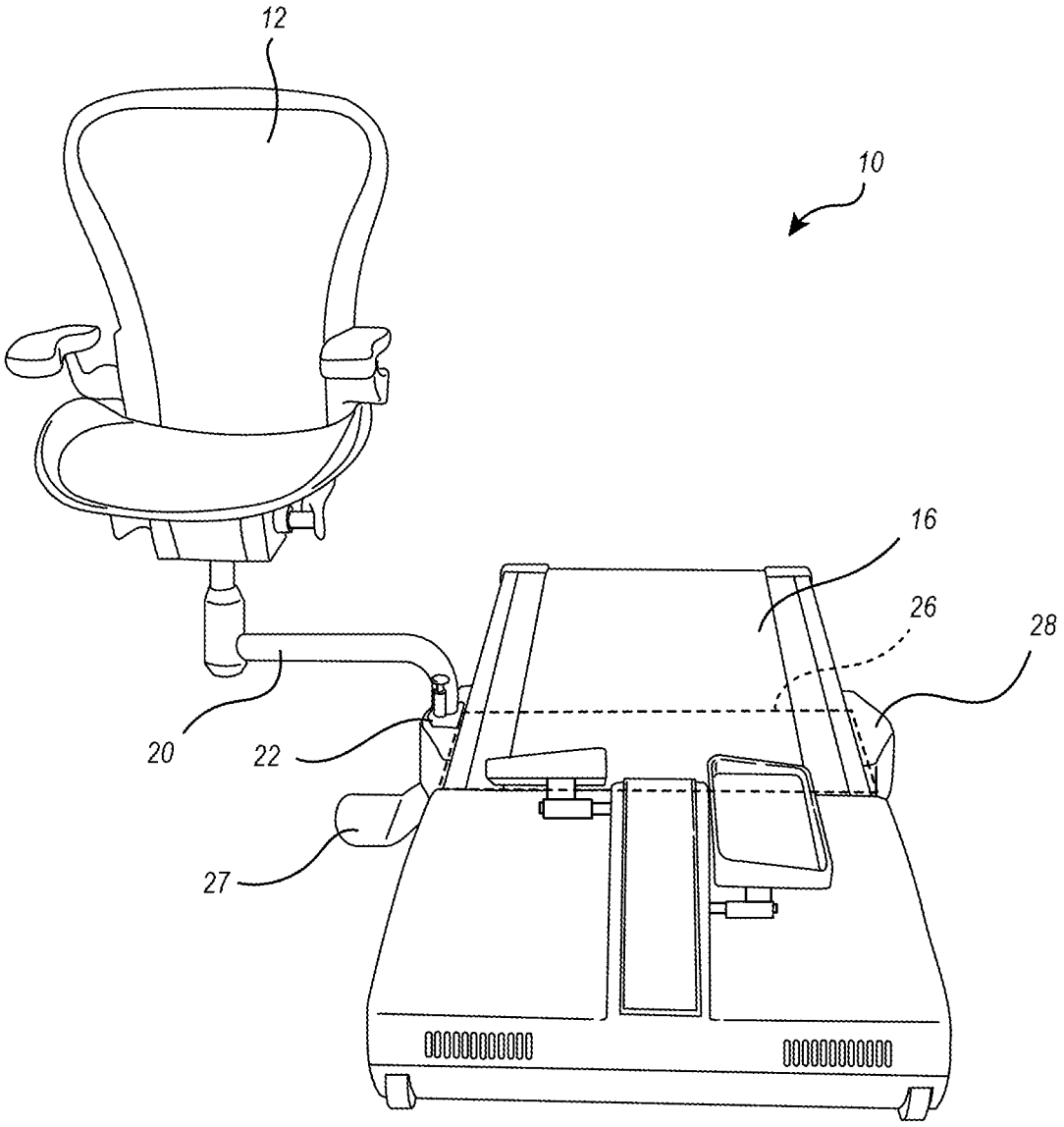
FIG. 11 is a front perspective view illustrating an embodiment of an exercise device for incorporation into a workstation, with a chair situated to a side of a treadmill and a support foot disposed to the side of the treadmill.

FIG. 11 illustrates an embodiment of an exercise workstation 10 with a chair 12 situated to one side of treadmill 16 and a support foot 27 disposed on the same side of treadmill 16. Support foot 27 extends away from treadmill 16 on the side where chair 12 is situated to prevent treadmill from tipping over during use. The size, shape, and material of support foot 27 may vary so long as support foot 27 effectively reduces the risk of treadmill 16 tipping over when a user sits on chair 12 that has been pivoted to the side of treadmill 16. The support foot 27 may be used alone or in conjunction with vertical support 28.

Figure 12:
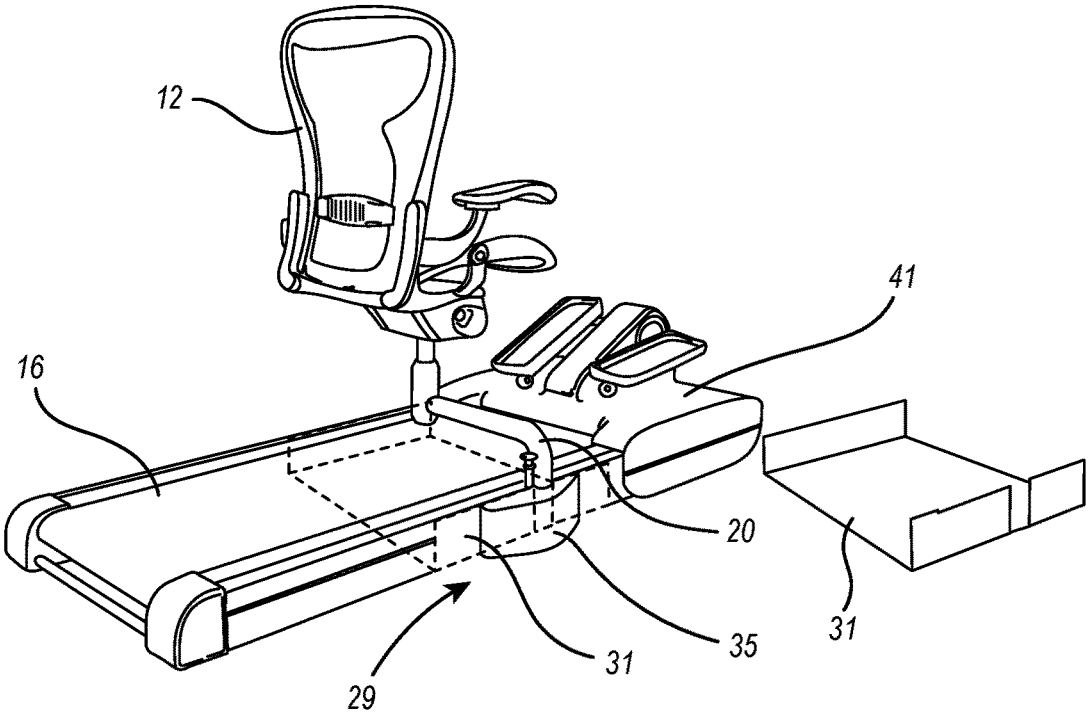
FIG. 12 is a side perspective view illustrating an embodiment of a chair attachment system for attaching a chair to a treadmill, with the chair shown situated above the treadmill and that can be selectively moved to a side of the treadmill.
Figure 13:
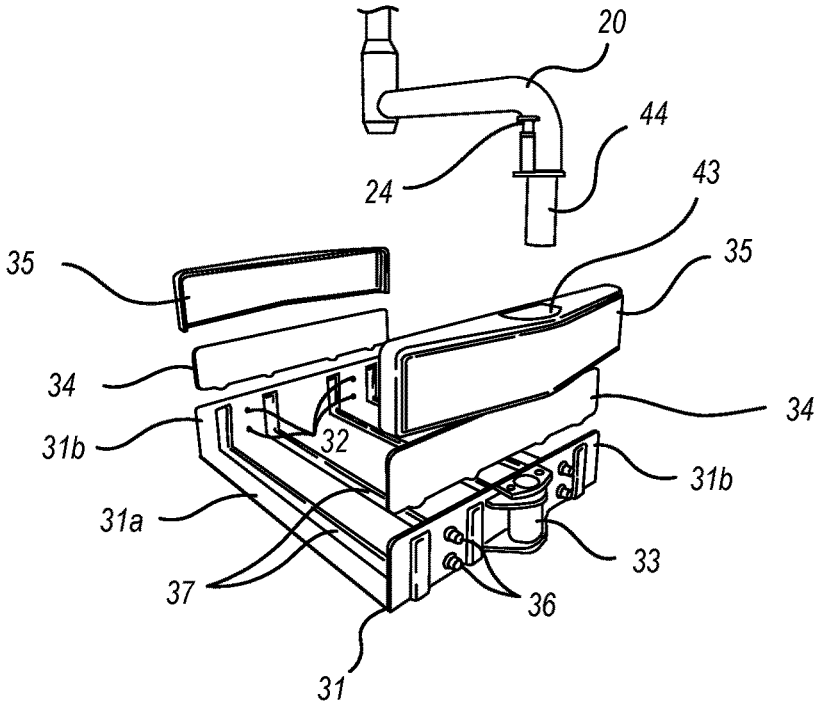
FIG. 13 is an exploded view of the chair attachment system illustrated in FIG. 12 for attaching a chair to a treadmill.
Figure 14:
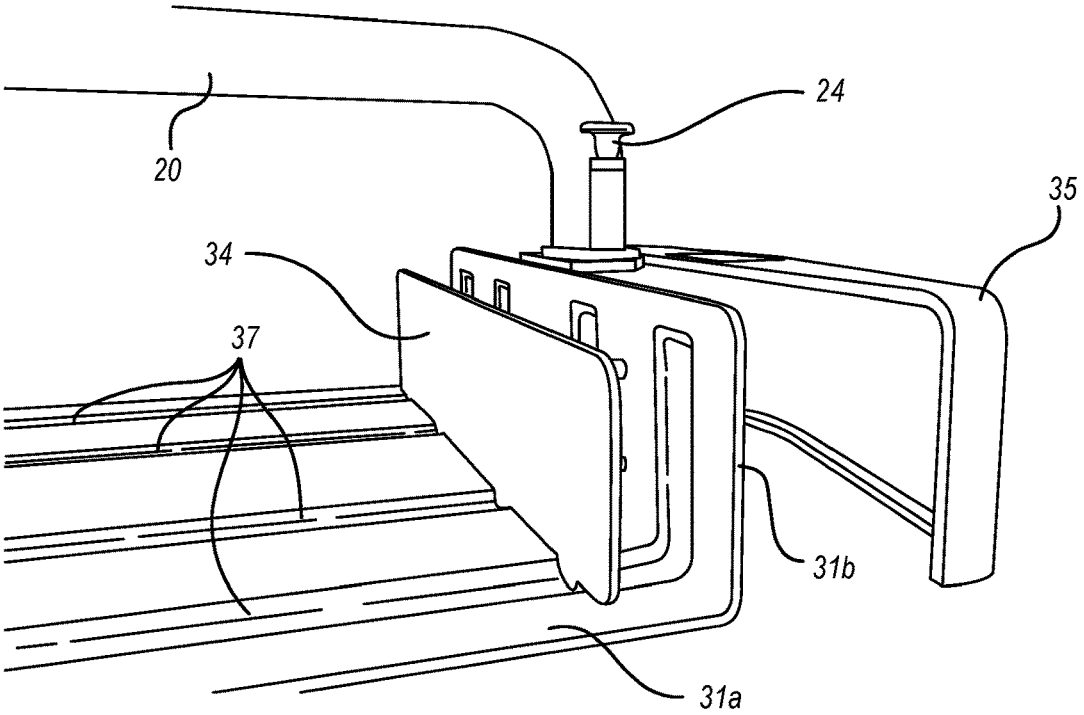
FIG. 14 is an exploded side view illustrating an attachment system for selectively attaching a chair to an exercise device such as a treadmill.
Figure 15:
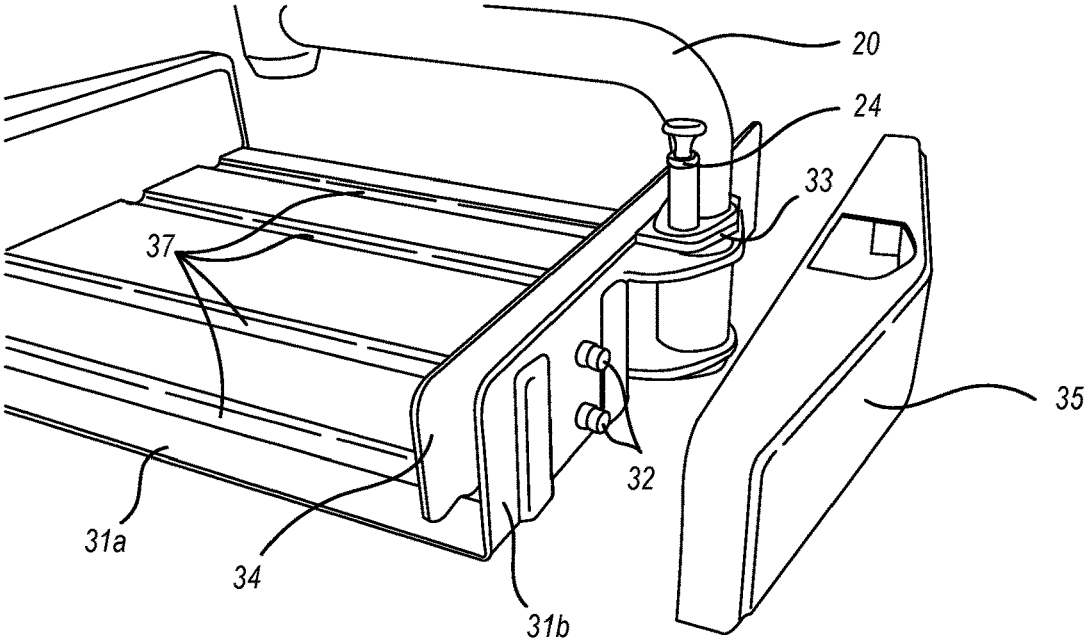
FIG. 15 is another exploded view illustrating view of the attachment system of FIG. 14.
Figure 16:
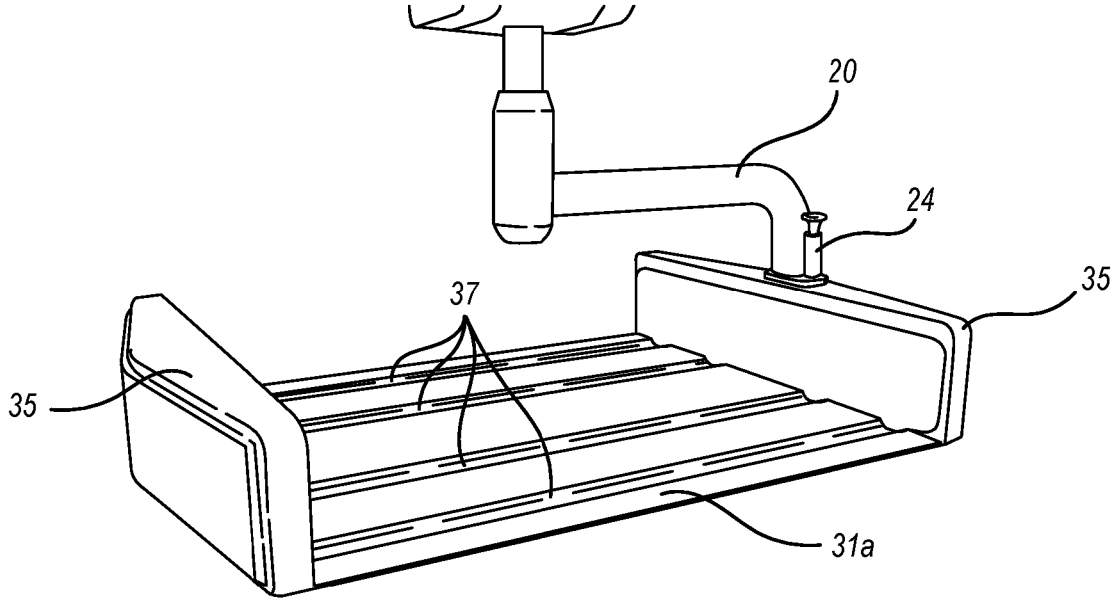
FIG. 16 is a side perspective view illustrating an assembled attachment system for selectively attaching a chair to an exercise device such as a treadmill.
Figure 17:
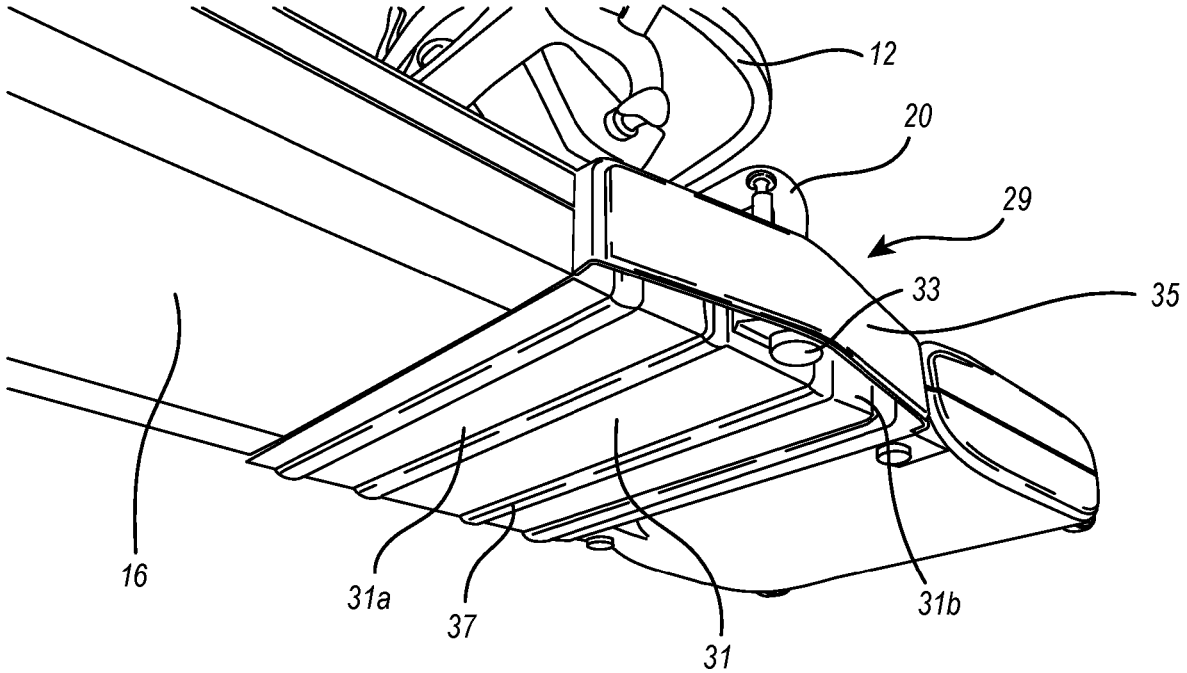
FIG. 17 is a bottom perspective view illustrating an exercise workstation.

FIG. 12 illustrates an embodiment of a workstation attachment system 29, including a treadmill 16, with the chair 12 situated above the treadmill 16. In at least one embodiment, workstation attachment system 29 may be selectively attached to any treadmill. This allows a user to purchase workstation attachment system 29 separately and add it to an existing treadmill. Workstation attachment system 29 may be positioned at any location along the length of the treadmill. As illustrated in FIGS. 12 and 13, workstation attachment system 29 may include a base 31, one or more holes 32 for faster(s) 36, one or more securing slats 34, one or more housing elements 35. The freedom to position workstation attachment system 29 anywhere along the length of the treadmill enables a user to accommodate spatial needs within a particular work area.

FIGS. 13-17 provide various detailed views of a workstation attachment system 29. Base 31 may include a middle bottom section 31*a* and opposing sidewalls 31*b*. Middle bottom section 31*a* will typically be wide enough to accommodate the width of a treadmill 16. In some embodiments, middle bottom section 31*a* may be adjustable to accommodate a variety of different treadmill widths. Middle bottom section 31*a* may be adjustable using a telescoping mechanism, or by adding or removing panels used to increase the width of middle bottom section 31*a*. Opposing sidewalls 31*b* of base 31 may be configured to extend in an upward direction adjacent to the outside walls of the treadmill 16. Opposing sidewalls 31*b* of base 31 may each include a plurality of holes 32. The plurality of holes 32 may be threaded in order to accommodate a plurality of fasteners 36. Fasteners 36 may be screws, bolts, pins, or the like.

Workstation attachment system 29 may also include at least one securing slat 34 (e.g., two securing slats 34). The at least one securing slat 34 may be positioned on the interior side of opposing sidewalls 31*b* so that one side of securing slat 34 comes into contact with a side of a treadmill and the other side of securing slat 34 faces an interior side of an opposing sidewall 31*b*. In some embodiments, the middle bottom section of the base 31*a* may include one or more sliding grooves 37, which may correspond to ridges on a bottom end of a securing slat 34. The one or more sliding grooves 37 may allow a securing slat 34 to remain in a specific position on base 31 by fitting the ridges on the bottom end of a securing slat 34 into sliding grooves 37.

Once base 31 is placed at a desired location underneath a treadmill, the at least one securing slat 34 may be placed on the interior side of an opposing sidewall 31*b*. Fasteners 36 may then be inserted from an exterior side of an opposing sidewall 31*b* through holes 32 in order to create force between securing slat 34 and the side of the treadmill, thereby securing workstation attachment system 29 to the treadmill.

In some embodiments, the workstation attachment system may be configured on a track, trolley, or the like to allow the user to easily adjust the position of the workstation attachment system along the length of the treadmill without having to pick up or raise the treadmill off the floor.

Workstation attachment system 29 may include one or more housing elements 35. Housing elements 35 may be placed over securing slats 34 and opposing sidewalls 31*b* once securing slats 34 have been secured in place against one or both sides of a treadmill by a plurality of fasteners 36. Housing elements 35 may provide an aesthetic benefit by covering the underlying mechanics of the base 31, plurality of fasteners 36, and securing slats 34, and may protect users from inadvertent injury caused by coming into contact with the exposed materials.

One or both housing elements 35 may include an opening 43 through which a pivot arm 20 may be connected to a pivot joint receiving member 33. A proximal end 44 of pivot arm 20 can be inserted through opening 43 and into pivot joint receiving member 33. At least one of opposing sidewalls 31*b* of base 31 may include a pivot joint receiving member 33. In some embodiments, multiple pivot joints may be included. In such an embodiment, the position of pivot joint receiving member 33 may be adjusted in order to adjust the position of a chair 12 attached to workstation attachment system 29.

Pivot arm 20 may extend from pivot joint receiving member 33 and may rotate about pivot joint receiving member 33 to reposition chair 12. For example, in at least one embodiment, a user may rotate pivot arm 20 to reposition chair 12 to the side of the treadmill, or above the treadmill but closer or further away from work surface 18. In addition, in at least one embodiment, pivot arm 20 is rotationally connected to chair 12 such that chair 12 can rotate relative to pivot arm 20 to face in different directions. Chair 12 may comprise an office chair or, in other embodiments, chair 12 may comprise other sitting devices in addition to or in place the illustrated chair. In some embodiments, pivot arm 20 may be compatible with an upper portion 45 of any chair preferred by the user, for example, any office chair comprising a lift 46, a backrest 39, and a seat 40 (see FIGS. 18A and 18B), so that the user may further customize workstation attachment system 29. Pivot arm 20 may include a pivot lock 24 which may interface with pivot joint receiving member 33 to maintain chair 12 in a specific position above or relative to a treadmill when in use, and to allow chair 12 to swing away from the seating position above the treadmill when chair 12 is not in use.

Figure 18A:
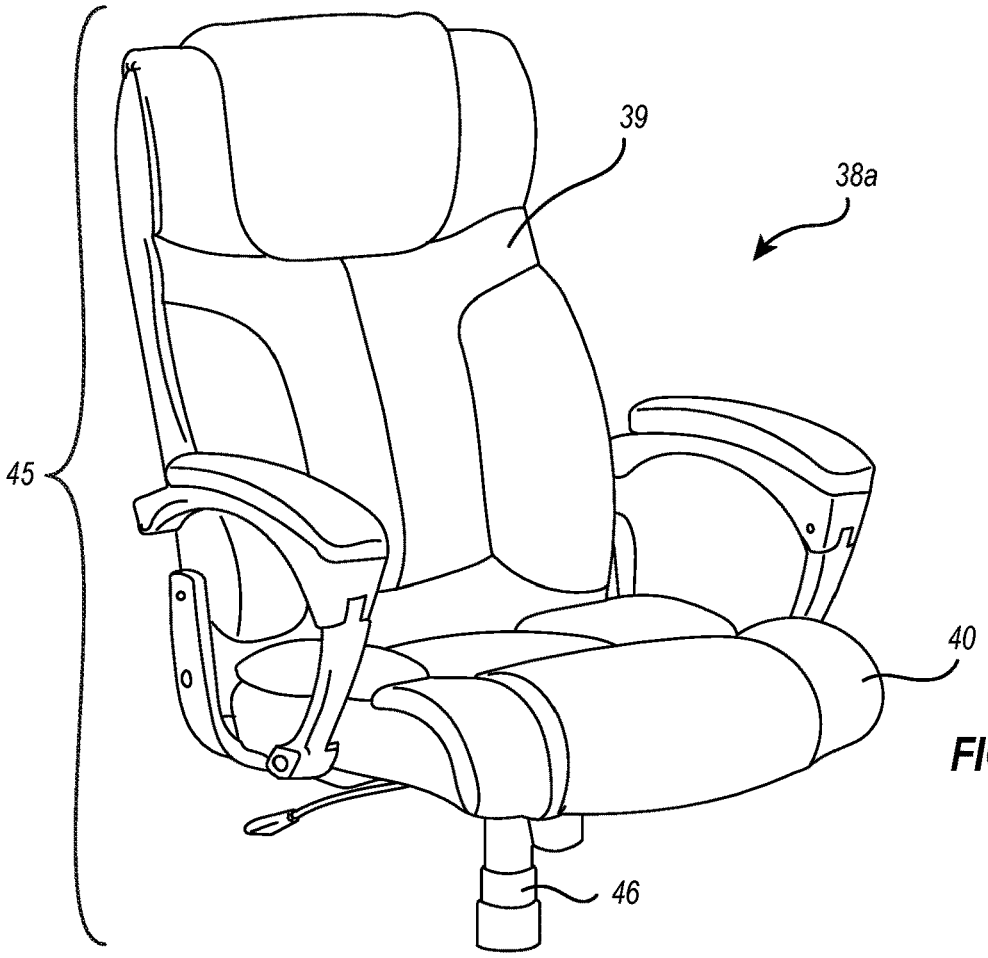
FIG. 18A is a side perspective view illustrating an embodiment of a folding chair that is adapted for incorporation into an exercise device, such as a treadmill, in an open, or deployed, configuration.
Figure 18B:
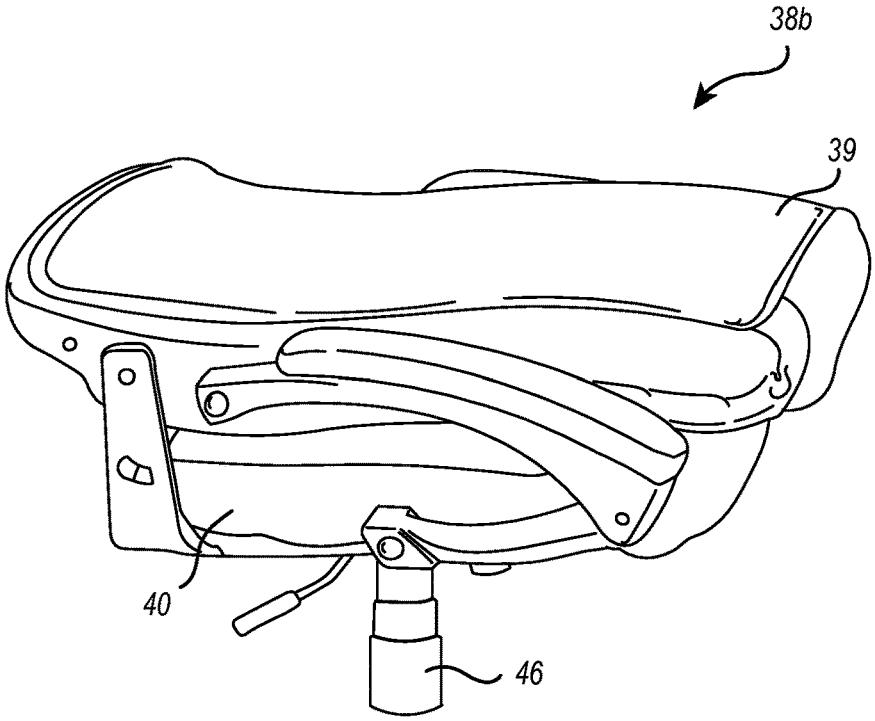
FIG. 18B is a side perspective view of the folding chair of FIG. 18A in a closed, or collapsed, configuration.

FIGS. 18A and 18B illustrate a compatible folding chair 38, which may be used in embodiments of an exercise workstation 10 and may also be used in embodiments of a workstation attachment system 29. In some embodiments, compatible folding chair 38 may comprise a typical office chair, which may or may not have arms depending on user preference. When in use, compatible folding chair 38 may be in an open position 38*a* (FIG. 18A). When compatible folding chair 38 is not in use, backrest 39 may be folded to a horizontal position 38*b* such that the compatible folding chair in in a "closed" position (FIG. 18B). This allows a user to move compatible folding chair 38 about the pivot arm 20 to store the compatible folding chair 38 under work surface 18 while the user is standing or walking on the treadmill. The folded position 38*b* may also be advantageous in order to take up less vertical space when compatible folding chair 38 is moved about the pivot arm 20 so that compatible folding chair 38 swings out and off to the side of the treadmill 16. In other embodiments, seat 40 of the compatible folding chair 38 may fold upwards into a vertical position (not shown) to increase the amount of lateral space available when pivoting compatible folding chair 38 in closed position 38*b* off to a side of a treadmill when the treadmill is used in tight spaces, such as cubicles and small offices.

Figure 19:
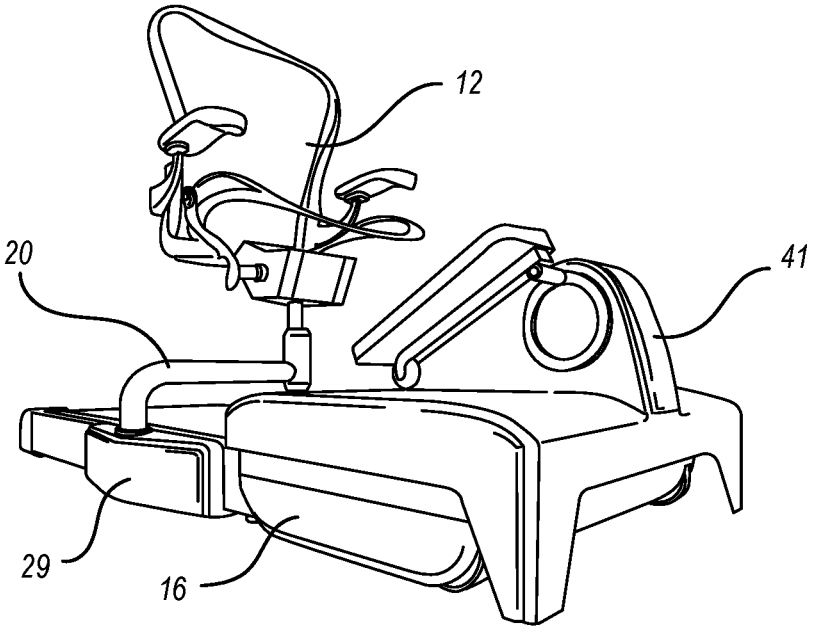
FIG. 19 is a side perspective view illustrating an embodiment of an elliptical pedal attachment system that can be situated at the front of a treadmill and a chair attachment system with the chair situated above the treadmill.

FIG. 19 illustrates an embodiment of a pedal exercise device attachment 41 situated on an end of treadmill 16 and workstation attachment system 29 with chair 12 situated above treadmill 16. Pedal exercise device attachment 41 may be selectively attached to any treadmill. Pedal exercise device 41 may be placed over a portion of the treadmill, which may be situated underneath a work surface so that when a user is seated they may continue to move their legs in a peddling motion. In some embodiments, pedal exercise device attachment 41 may be used by the user in a standing position.

Figure 20:
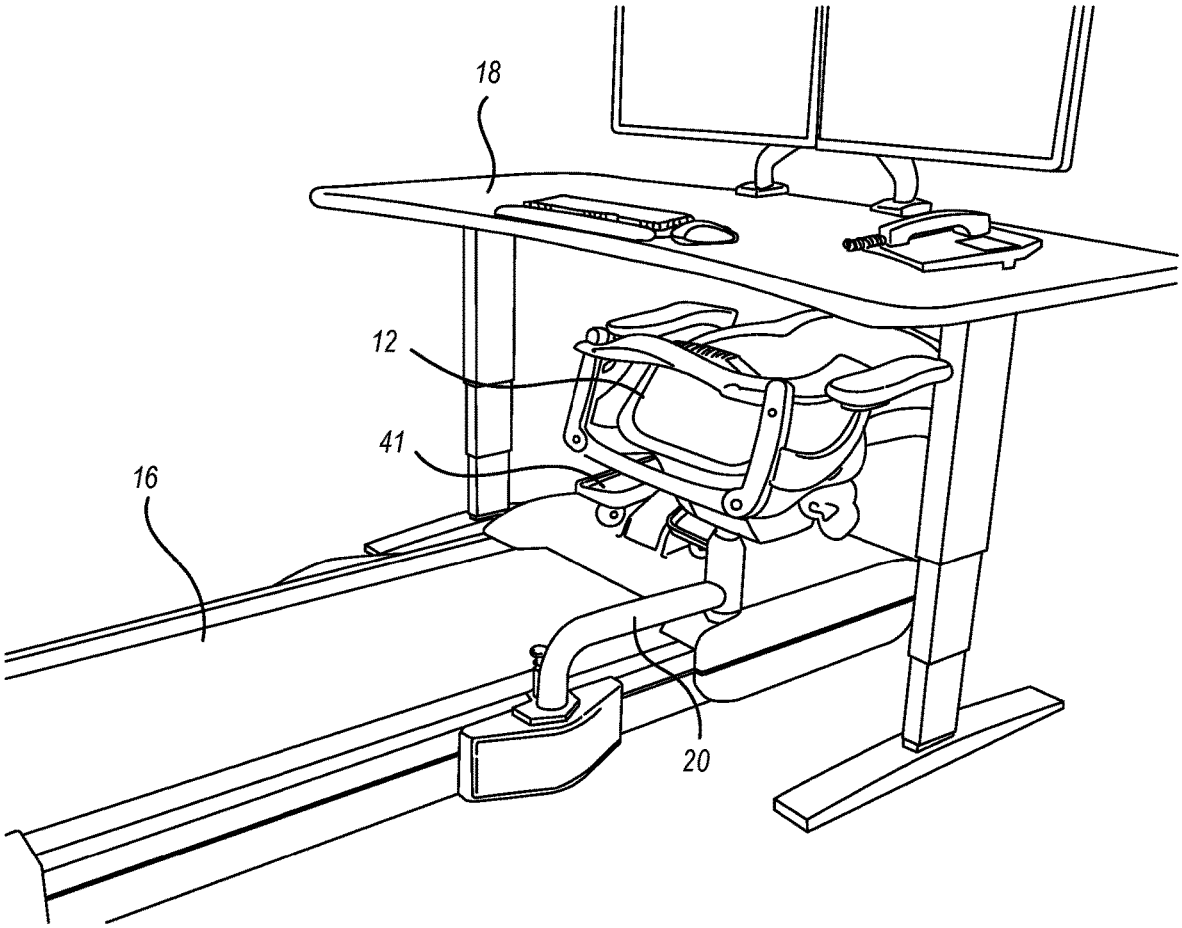
FIG. 20 is a side perspective view illustrating an embodiment of an exercise workstation with a chair folded and stored under the work surface.
Figure 21:
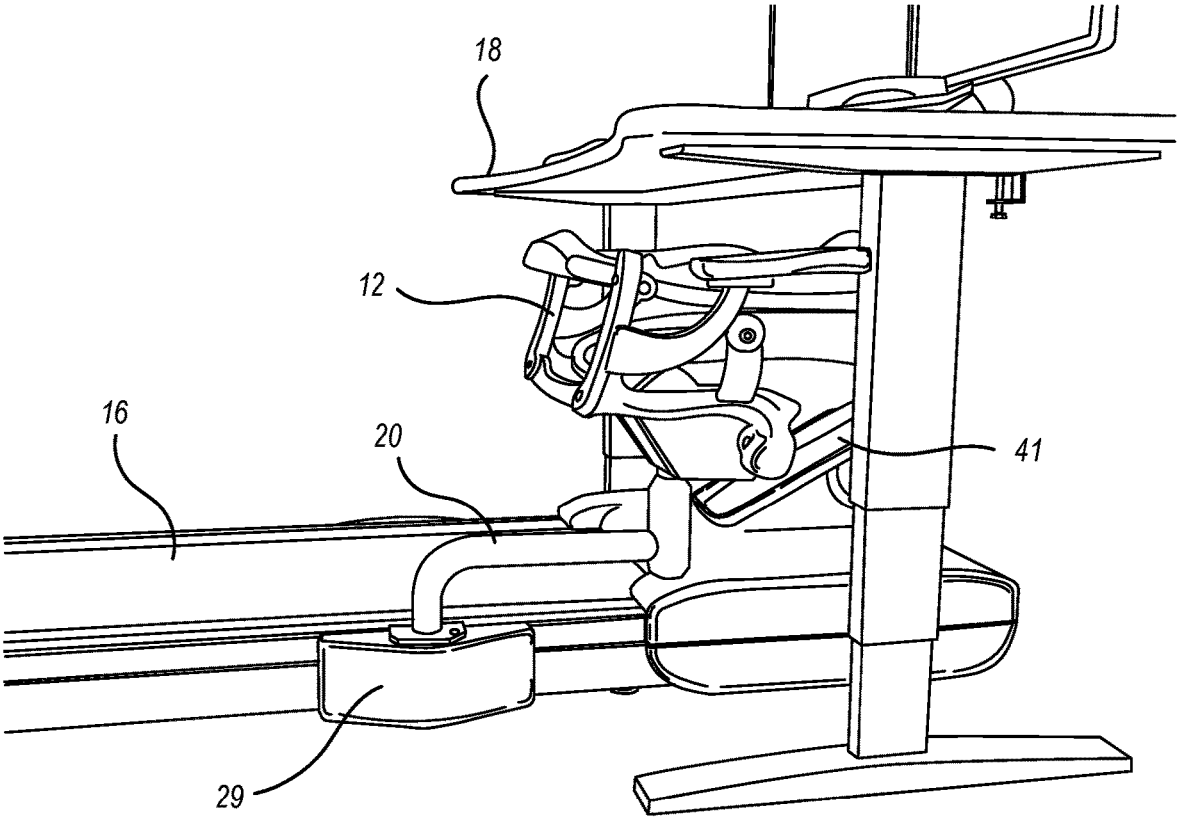
FIG. 21 is a side view illustrating an embodiment of an exercise workstation with a chair folded and stored under the work surface.
Figure 22:
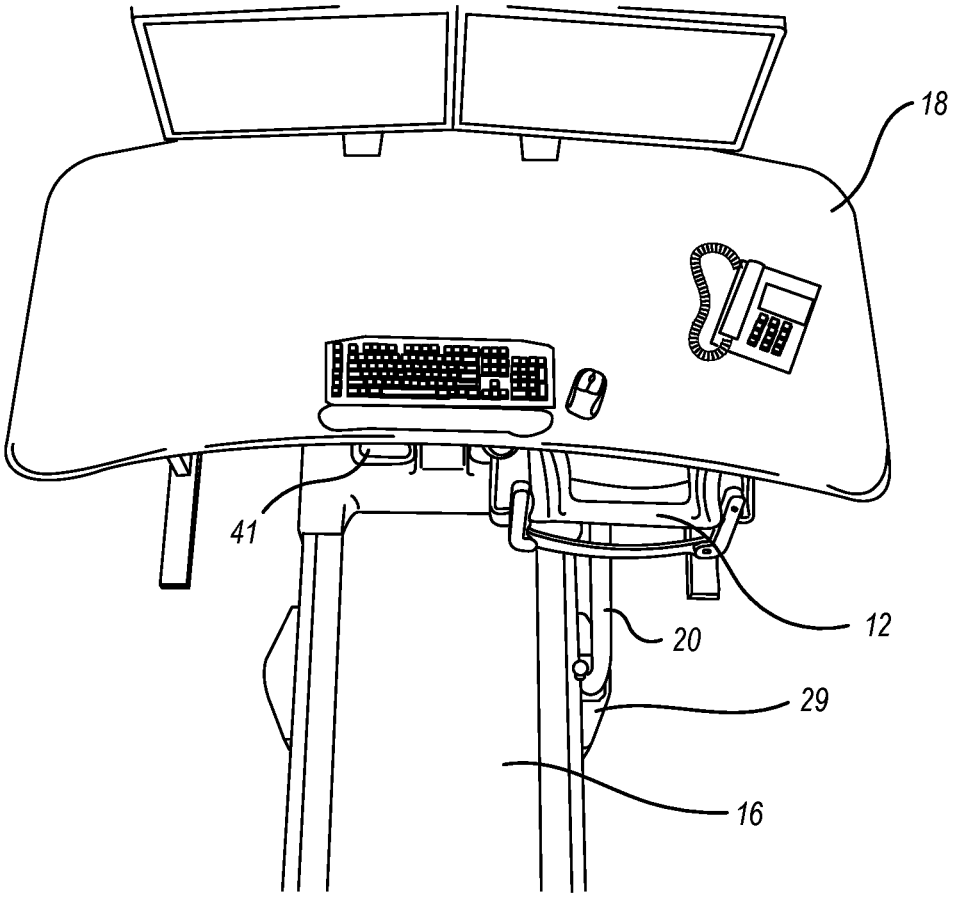
FIG. 22 is a top view illustrating an embodiment of an exercise workstation with a chair folded and stored under the work surface.

FIGS. 20-22 illustrate an exercise workstation of the present disclosure, with chair 12 folded into a closed position and stored under work surface 18 so that the user may stand or walk on treadmill 16. When chair 12 is folded, pivot arm 20 may allow the chair to be easily moved and stored under work surface 18.

Figure 23:
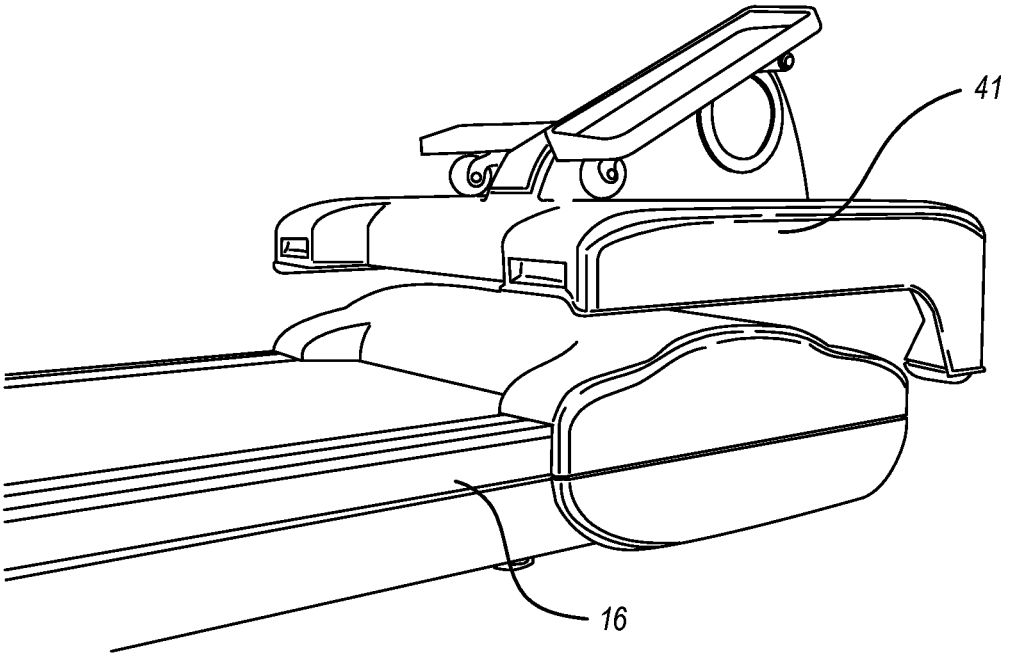
FIG. 23 is an exploded perspective view illustrating an exercise pedal device and attachment positioned at the front end of a treadmill.

FIG. 23 illustrates an elliptical pedal exercise device attachment 41 positioned over a front end of treadmill 16. A user may elect to be seated in a chair (not shown), though the user may prefer to be moving their legs or exercising while seated. Elliptical pedal exercise device attachment 41 may be positioned on a front end of treadmill 16 to allow the user to sit or stand at a work surface and pedal. Elliptical pedal exercise device attachment 41 can be used in conjunction with workstation attachment system 29 or with workstation 10.

In addition to the embodiments and features shown in the figures and described above, at least one embodiment of an exercise workstation according to the present disclosure includes a number of other features. For example, in at least one embodiment, an exercise workstation includes one or more processors and computer readable memory which communicates with a software application for tracking and reporting fitness objectives. A wireless transmitter may also be employed in conjunction with a wearable device or one or more fitness tracking devices used in conjunction with the treadmills and pedals described herein. Such a software application may be in the form of a mobile phone application, computer software application, or website. Such an application may also utilize cloud-based computing and storage.

In at least one embodiment, one or more software applications can track and report time spent exercising, either using the treadmill or pedals, how many calories are burned by the user, and/or heart-rate information during and after use. The software application may also allow a user to set fitness goals and communicate progress towards an achievement of such goals. In at least one embodiment, a software application may track time used, number of steps, number of pedals, distance travelled, speed, calories burned, pedal resistance, and the like during use. Also, at least one embodiment includes alerts that inform a user when treadmill 16 or pedals 14 have been stationary for a certain amount of time to remind users to continue walking or pedaling.

Such a software app may also sync with popular fitness apps, watches, phones and other devices currently on the market. In at least one embodiment, the information gathered by the software app can be used in conjunction with corporate wellness programs to track individual, group, or company results. In at least one embodiment, a user interface may be included on or in the various work surfaces, chairs, treadmills, or other components of exercise workstations described herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The invention claimed is:

1. An exercise workstation, comprising:

a treadmill;

a pedal exercise device disposed on or next to the treadmill; and a seating assembly, the seating assembly comprising:

a pivot joint, wherein the pivot joint is connected to a side of the treadmill;

a pivot arm pivotally connected to the pivot joint; and a chair connected to the pivot arm and pivotally secured to a portion of the exercise workstation such that the chair is repositionable relative to the treadmill, the chair being configured to laterally rotate or swivel relative to the pivot arm and is configured to be pivotally repositioned either over the treadmill or laterally to a side of the treadmill by pivoting the pivot arm relative to the pivot joint during use;

wherein the pivot joint further comprises a pivot lock configured to selectively lock the chair in a desired position.

2. The exercise workstation of claim 1, further comprising a work surface positioned adjacent to at least one of the treadmill, pedal exercise device, or the chair.

3. The exercise workstation of claim 2, wherein the work surface is height adjustable.

4. The exercise workstation of claim 1, wherein the chair is a swivel chair that is laterally rotatable relative to the pivot arm.

5. The exercise workstation of claim 1, wherein the pedal exercise device comprises or is operably connected to a power generator that generates electrical power when a user operates the pedal exercise device.

6. An exercise workstation, comprising:

a treadmill; and a workstation attachment system configured to be selectively mounted on and removable from the treadmill, the workstation attachment system comprising:

a pivot joint configured to be connected to one side of the treadmill;

a pivot arm pivotally connected to the pivot joint; and a chair pivotally connected to the pivot arm such that the chair is configured to laterally rotate or swivel relative to the pivot arm and is configured to be pivotally repositioned either over the treadmill or laterally to a side of the treadmill by pivoting the pivot arm relative to the pivot joint during use, wherein the pivot joint further comprises a pivot lock configured to selectively lock the chair in a desired position.

7. The exercise workstation of claim 6, further comprising a pedal exercise device.

8. The exercise workstation of claim 7, wherein the pedal exercise device is integrally connected to the treadmill.

9. The exercise workstation of claim 7, wherein the pedal exercise device is removably connected to the treadmill.

10. The exercise workstation of claim 6, wherein the workstation attachment system further comprises at least one support foot.

11. The exercise workstation of claim 6, further comprising a support plate extending underneath the treadmill, the support plate being connected to the pivot joint.

12. The exercise workstation of claim 6, further comprising a pedal exercise device and an electric generator associated therewith that is configured such that when the pedal exercise device is engaged, the electric generator generates electrical power.

13. The exercise workstation of claim 6, wherein the workstation attachment system further comprises a track positioned along the length of the treadmill providing for repositioning of the workstation attachment system along the track along the length of the treadmill.

14. An exercise workstation, comprising:

a treadmill; and a workstation attachment system configured to be selectively mounted on and removable from the treadmill, the workstation attachment system comprising:

a base, wherein the base has a bottom middle section and opposing sidewalls extending upwards, wherein the opposing sidewalls have a plurality of holes;

a pivot joint fixed to an external side of at least one of the opposing sidewalls;

one or more securing slats positioned on interior sides of the opposing sidewalls of the base;

one or more fasteners, wherein the one or more fasteners are inserted from an exterior side of the opposing sidewalls through the plurality of holes of the opposing sidewalls and tightened to cause the securing slats to be secured against a side of a treadmill; and at least one housing element, wherein the housing element covers the base, the securing slats, and the fasteners and wherein the housing element has an opening to allow the pivot joint to receive a pivot arm.

15. The exercise workstation of claim 14, further comprising a pivot arm pivotally attached to the pivot joint.

* * * * *